US007963372B2

(12) United States Patent
Hikita

(10) Patent No.: US 7,963,372 B2
(45) Date of Patent: Jun. 21, 2011

(54) EVACUATION ASSISTANCE DEVICE FOR ELEVATOR

(75) Inventor: Shiro Hikita, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 516 days.

(21) Appl. No.: 12/161,359

(22) PCT Filed: Jul. 6, 2006

(86) PCT No.: PCT/JP2006/313481
§ 371 (c)(1),
(2), (4) Date: Jul. 18, 2008

(87) PCT Pub. No.: WO2008/004295
PCT Pub. Date: Jan. 10, 2008

(65) Prior Publication Data

US 2010/0236868 A1 Sep. 23, 2010

(51) Int. Cl.
*B66B 1/18* (2006.01)

(52) U.S. Cl. ..... 187/387; 187/384; 187/313; 187/393; 187/390

(58) Field of Classification Search ..... 187/247, 187/248, 313, 316, 317, 380–388, 390–393
See application file for complete search history.

(56) References Cited

U.S. PATENT DOCUMENTS

| | | | | |
|---|---|---|---|---|
| 4,023,146 | A * | 5/1977 | Carroll | 710/113 |
| 6,000,505 | A * | 12/1999 | Allen | 187/391 |
| 7,182,174 | B2 * | 2/2007 | Parrini et al. | 182/18 |
| 7,210,564 | B2 * | 5/2007 | Kawai | 187/384 |

(Continued)

FOREIGN PATENT DOCUMENTS

| | | |
|---|---|---|
| JP | 51 23935 | 2/1976 |
| JP | 58 52171 | 3/1983 |
| WO | 2004 101418 | 11/2004 |

OTHER PUBLICATIONS

Sekizawa, Ai et al., "Study on Feasibility of Evacuation using Elevators in a High-rise Building (Part.2)", Study Report Abstracts of National Reseach Institute of Fire and Disaster, pp. 590-593, (2004).

*Primary Examiner* — Jonathan Salata
(74) *Attorney, Agent, or Firm* — Oblon, Spivak, McClelland, Maier & Neustadt, L.L.P.

(57) ABSTRACT

An elevator evacuation support apparatus evacuates building occupants that have been left inside a building to a refuge floor in an emergency by managing operation of an elevator in which a plurality of floors function as service floors. The elevator evacuation support apparatus has an evacuating operation implementing portion, an evacuating operation time calculating portion, and an evacuating operation determining portion. The evacuating operation implementing portion designates at least one of the service floors as a rescue floor, and implements an evacuating operation for the elevator for transporting the building occupants from the rescue floor to the refuge floor. The evacuating operation time calculating portion receives urgency level information that indicates a degree of urgency, and calculates an estimated amount of time for continuing the evacuating operation as an evacuating operation time based on the urgency level information. The evacuating operation determining portion determines ability to continue the evacuating operation based on information from the evacuating operation time calculating portion. The evacuating operation implementing portion controls the evacuating operation based on information from the evacuating operation determining portion.

2 Claims, 2 Drawing Sheets

U.S. PATENT DOCUMENTS 7,461,723 B2 * 12/2008 Kawai ..... 187/313
7,588,126 B2 * 9/2009 Siikonen et al. ..... 187/384
7,594,564 B2 * 9/2009 Siikonen et al. ..... 187/384
7,621,378 B2 * 11/2009 Kawai ..... 187/313
7,669,695 B2 * 3/2010 Hikita et al. ..... 187/284
7,677,363 B2 * 3/2010 Kawai ..... 187/387
7,743,889 B2 * 6/2010 Kawai ..... 187/313

* cited by examiner

EVACUATION ASSISTANCE DEVICE FOR ELEVATOR

TECHNICAL FIELD

The present invention relates to an elevator evacuation support apparatus for evacuating building occupants that have been left inside a building in an emergency.

BACKGROUND ART

Evacuation methods that use elevators in order to evacuate building occupants when a fire has broken out in a building have been proposed conventionally (see Non-Patent Literature 1).

Non-Patent Literature 1

SEKIZAWA, Ai, et al., "Study on Feasibility of Evacuation by Elevators in a High-Rise Building (No. 2)", 2004 Study Report Abstracts of National Research Institute of Fire and Disaster, pp. 590-593.

DISCLOSURE OF THE INVENTION

Problem to be Solved by the Invention

However, in emergencies in which the possibility that operation of the elevator may be forcibly stopped is increasing rapidly such as when advance warning of a terrorist attack has been received, for example, if evacuating operation of the elevator is continued without any restrictions, the possibility that operation of the elevator may be stopped abnormally while transporting building occupants is increased, and there is a risk that evacuation of the building occupants may become even more difficult.

The present invention aims to solve the above problems and an object of the present invention is to provide an elevator evacuation support apparatus that can prevent abnormal stoppage of evacuating operation of an elevator.

Means for Solving the Problem

In order to achieve the above object, according to one aspect of the present invention, there is provided an elevator evacuation support apparatus that evacuates building occupants that have been left inside a building to a refuge floor in an emergency by managing operation of an elevator in which a plurality of floors function as service floors, the elevator evacuation support apparatus including: an evacuating operation implementing portion that designates at least one of the service floors as a rescue floor, and that implements an evacuating operation for the elevator for transporting the building occupants from the rescue floor to the refuge floor; an evacuating operation time calculating portion that receives urgency level information that indicates a degree of urgency, and that calculates an estimated amount of time for continuing the evacuating operation as an evacuating operation time based on the urgency level information; and an evacuating operation determining portion that determines ability to continue the evacuating operation based on information from the evacuating operation time calculating portion, the elevator evacuation support apparatus being characterized in that the evacuating operation implementing portion controls the evacuating operation based on information from the evacuating operation determining portion.

BEST MODE FOR CARRYING OUT THE INVENTION

A preferred embodiment of the present invention will now be explained with reference to the drawings.

Embodiment 1

Figure 1:
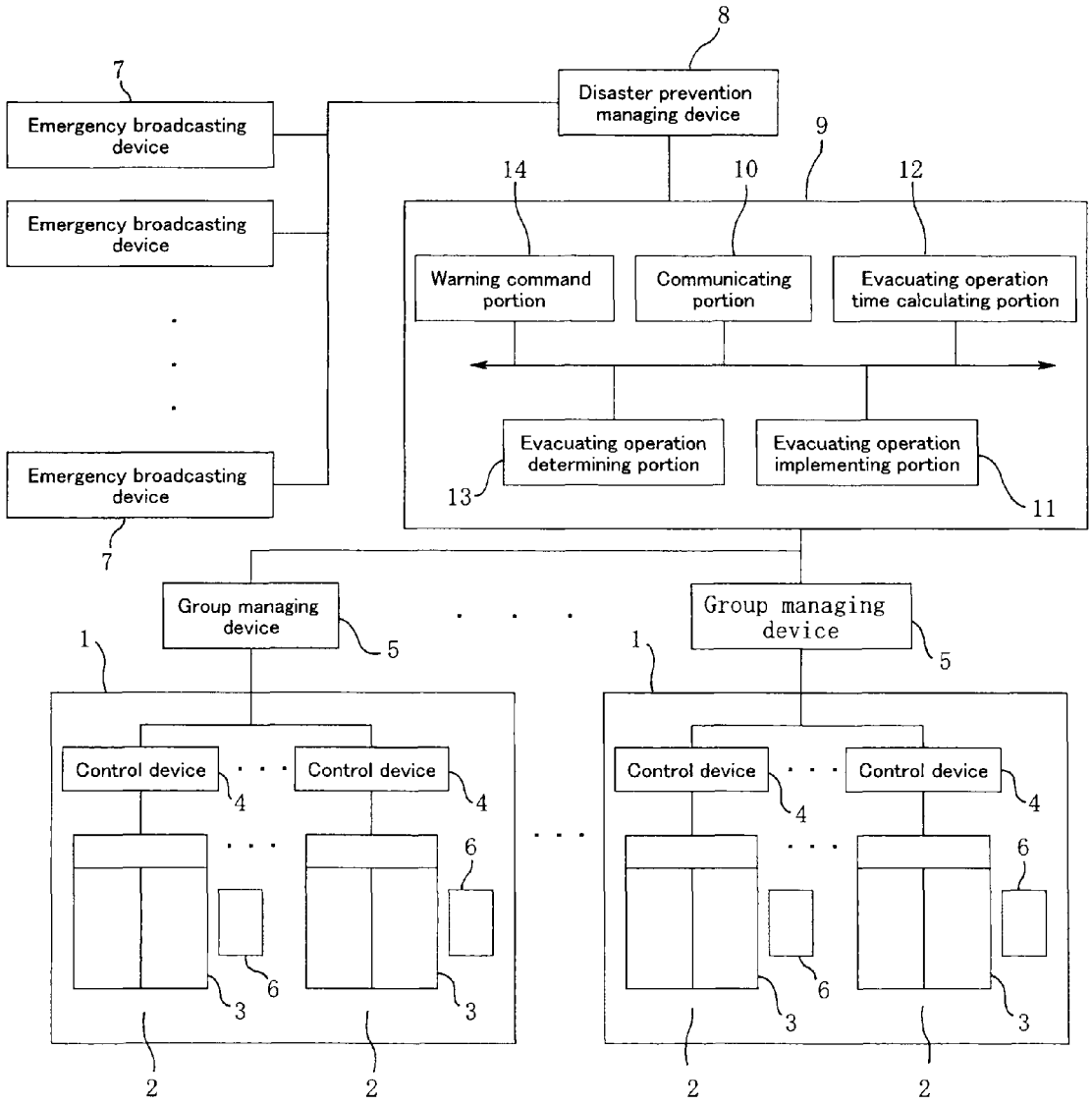
FIG. 1 is a block diagram that shows an elevator evacuation support apparatus according to Embodiment 1 of the present invention.

FIG. 1 is a block diagram that shows an elevator evacuation support apparatus according to Embodiment 1 of the present invention. In the figure, a plurality of elevator groups 1 are disposed in a building (not shown). Each of the elevator groups 1 has a plurality of elevators 2 in which a plurality of floors function as service floors. Each of the elevators 2 has: a car 3 that can stop at each of the service floors and a refuge floor; and a control device 4 that controls movement of the car 3. In this example, the refuge floor is considered to be a lobby floor on which an entrance to the building is disposed.

A group managing device 5 for managing operation of each of the elevators 2 simultaneously is disposed on each of the elevator groups 1. Landing call buttons 6 for registering landing calls for each of the elevators 2 are also disposed on each of the service floors and the refuge floor. When a landing call is registered by operating a landing call button 6, a car 3 is assigned to respond to the landing call from among the cars 3 in the elevator group 1 by the group managing device 5.

Emergency broadcasting devices (warning devices) 7 for issuing a guiding broadcast that relates to evacuation guidance to the whole building are disposed on each floor of the building. A control center (disaster prevention center) for centrally monitoring and controlling equipment that relates to disaster prevention is also installed in the building. A disaster prevention managing device 8 that collectively manages the disaster prevention machinery of the whole building, and an evacuation support apparatus 9 that collectively manages each of the group managing devices 5 in an emergency such as when advance warning of a terrorist attack has been received, for example, are disposed in the control center.

The evacuation support apparatus 9 performs an evacuating operation for carrying building occupants that have been left inside the building to the refuge floor for each of the elevator groups 1 by collectively managing each of the group managing devices 5. Operating input information that relates to the evacuating operation can be input to the evacuation support apparatus 9 by operating an external input device (not shown) that is disposed inside the control center. The evacuating operation is controlled based on the operating input information that the evacuation support apparatus 9 has received.

A personal computer (PC), etc., may used for the external input device, for example. Urgency level information that indicates a degree of urgency (such as information that relates to an estimated time of a terrorist attack (a time limit) that is derived from contents of the advance notice of terrorism, for example) is included in the operating input information. Moreover, the external input device may also be mounted directly to the evacuation support apparatus 9.

The evacuation support apparatus 9 has: a communicating portion 10, an evacuating operation implementing portion 11, an evacuating operation time calculating portion 12, an evacuating operation determining portion 13, and a warning command portion 14.

The communicating portion 10 performs information communication between the evacuation support apparatus 9 and each of the group managing devices 5, the disaster prevention managing device 8, and the external input device, respectively.

The evacuating operation implementing portion 11 implements an evacuating operation for each of the elevators 2 by outputting a command for the evacuating operation to each of the group managing devices 5. The evacuating operation is performed by designating at least one of the service floors as a rescue floor, and moving the cars 3 between the rescue floor and the refuge floor. If a landing call button 6 is operated on a landing of a rescue floor during the evacuating operation, a car 3 that can respond to the landing call is moved to the relevant rescue floor by control from a control device 4. The car 3 that has arrived at the rescue floor is moved to the refuge floor after the building occupants have boarded.

In this example, the evacuating operation implementing portion 11 designates all of the service floors as rescue floors. Thus, each of the cars 3 can stop at all of the service floors and the refuge floor during the evacuating operation. In other words, the evacuating operation of each of the elevators can be considered to be identical to normal operation by normal control.

The evacuating operation time calculating portion 12 receives operating input information from the external input device, and calculates an estimated amount of time for continuing the evacuating operation as an evacuating operation time for each of the elevators 2 based on the operating input information.

In this example, the calculation of the evacuating operation time is performed based on the information of the estimated time of the terrorist attack. Specifically, the evacuating operation time is calculated in such a way that the evacuating operation will be completed before the estimated time of the terrorist attack (the time limit). More specifically, the calculation of the evacuating operation time for each of the elevators 2 is performed as described below.

First, respective lap times are calculated for each of the elevators 2. A "lap time" is the amount of time for one cycle from when a car 3 departs a refuge floor, allows building occupants that are left on each rescue floor to board the car 3 sequentially, returns to the refuge floor, allows all of the building occupants to alight, then departs from the refuge floor again.

Surplus time T for each of the elevators 2 is subsequently found based on the lap time. For example, if the lap time is less than five minutes, then the surplus time T will be five minutes, and if the lap time is longer than five minutes and less than 10 minutes, then the surplus time T will be ten minutes. The evacuating operation time for each of the elevators 2 is subsequently calculated based on the surplus time T. In this example, the evacuating operation time for each of the elevators 2 is calculated in such a way that the evacuating operation will be completed earlier than the estimated time of the terrorist attack by an amount equal to the surplus time T. Moreover, the surplus time T may also be set in advance to a constant value such as fifteen minutes, for example.

The evacuating operation determining portion 13 determines ability to continue the evacuating operation for each of the elevators 2 based on information from the evacuating operation time calculating portion 12. Specifically, the evacuating operation determining portion 13 issues a determination that continuation of the evacuating operation is possible for each of the elevators 2 (continuation possible determination) if the amount of time since commencing the evacuating operation is within the evacuating operation time, and issues a determination that continuation of the evacuating operation is impossible for each of the elevators 2 (continuation impossible determination) if the amount of time since commencing the evacuating operation exceeds the evacuating operation time.

The emergency operation implementing portion 11 controls the evacuating operation for each of the elevators 2 based on information from the evacuating operation determining portion 13. Specifically, the emergency operation implementing portion 11 commences the evacuating operation for each of the elevators 2 if the evacuating operation determining portion 13 starts issuing continuation possible determinations. The emergency operation implementing portion 11 continues the evacuating operation for each of the elevators 2 while the evacuating operation determining portion 13 is issuing continuation possible determinations, and terminates the evacuating operation for each of the elevators 2 if the evacuating operation determining portion 13 issues a continuation impossible determination.

The warning command portion 14 controls each of the emergency broadcasting devices 7 based on information from the evacuating operation determining portion 13. Specifically, the warning command portion 14 outputs an evacuation warning command to each of the emergency broadcasting devices 7 while the evacuating operation determining portion 13 is issuing continuation possible determinations, and outputs a termination warning command to each of the emergency broadcasting devices 7 if the evacuating operation determining portion 13 issues a continuation impossible determination. In this example, transmission of the commands from the warning command portion 14 to each of the emergency broadcasting devices 7 is performed by means of the disaster prevention managing device 8.

When an evacuation warning command is received, each of the emergency broadcasting devices 7 issues a warning inside the building that evacuation by the evacuating operation of each of the elevators 2 is possible. When a termination warning command is received, each of the emergency broadcasting devices 7 issues a warning inside the building that the evacuating operation of the elevators 2 will terminate.

The evacuation support apparatus 9 is constituted by a computer that has: an arithmetic processing portion (a CPU), a memory portion (ROM, RAM, etc.), and a signal input/output portion. The functions of the communicating portion 10, the evacuating operation implementing portion 11, the evacuating operation time calculating portion 12, the evacuating operation determining portion 13, and the warning command portion 14 are implemented by the computer of the evacuation support apparatus 9.

In other words, a program for implementing the functions of the communicating portion 10, the evacuating operation implementing portion 11, the evacuating operation time calculating portion 12, the evacuating operation determining portion 13, and the warning command portion 14 is stored in the memory portion of the computer. Information concerning each of the rescue floors, etc., is also stored in the memory portion. The arithmetic processing portion carries out arithmetic processing that relates to the functions of the evacuation support apparatus 9 based on the program that has been stored in the memory portion.

Figure 2:
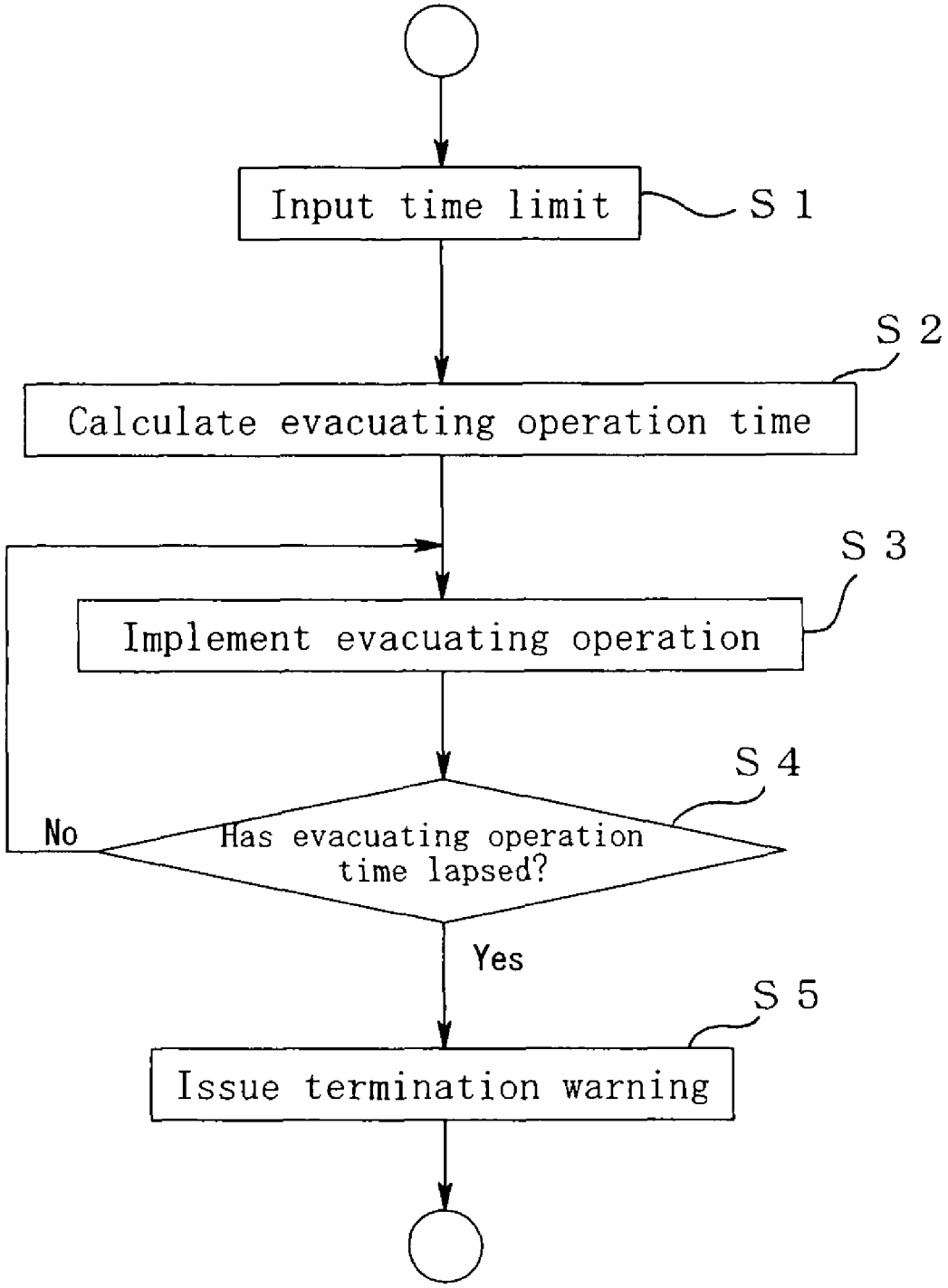
FIG. 2 is a flowchart for explaining a processing operation of the evacuation support apparatus in FIG. 1.

Next, operation will be explained. FIG. 2 is a flowchart for explaining a processing operation of the elevator evacuation support apparatus 9 in FIG. 1. As shown in the figure, if advance warning of a terrorist attack is received, for example, the external input device is operated by a guard in the control center, and operating input information that includes the time limit (the urgency level information) that is the estimated time of the terrorist attack is input into the evacuation support apparatus 9 from the external input device (S1).

When the operating input information from the external input device is input into the evacuation support apparatus 9, the evacuating operation time is calculated by the evacuating operation time calculating portion 12 based on the time limit (S2). The evacuating operation of each of the elevators 2 is subsequently implemented by control from the evacuating operation implementing portion 11 (S3).

The evacuating operation determining portion 13 subsequently determines whether the evacuating operation time has lapsed (S4). If the evacuating operation time has not lapsed, implementation of the evacuating operation of each of the elevators 2 is continued (S3). In that case, an evacuation warning command is output from the warning command portion 14 to each of the emergency broadcasting devices 7. A warning to the effect that evacuation by the evacuating operation of each of the elevators 2 is possible is thereby issued inside the building by each of the emergency broadcasting devices 7.

If, on the other hand, the evacuating operation time has lapsed, the evacuating operation of each of the elevators 2 is terminated by control from the evacuating operation implementing portion 11. At that point, the cars 3 are moved promptly to the refuge floor, and are stopped normally with the doors left open. At that point, the termination warning command is also output to each of the emergency broadcasting devices 7 from the warning command portion 14, and a warning to the effect that the evacuating operation of each of the elevators 2 will terminate is issued inside the building by each of the emergency broadcasting devices 7 (S5).

If building occupants are subsequently left inside the building, the building occupants will be guided by each of the emergency broadcasting devices 7 to evacuate by stairways, etc., for example.

In an elevator evacuation support apparatus of this kind, because the estimated amount of time to continue evacuating operation is calculated as an evacuating operation time based on urgency level information that indicates the degree of urgency, such as the estimated time of a terrorist attack, for example, and the ability to continue the evacuating operation is determined based on the calculated evacuating operation time, building occupants can be conveyed to the refuge floor efficiently in an emergency, and the evacuating operation of each of the elevators 2 can also be terminated before the possibility that the operation of each of the elevators 2 will be stopped abnormally becomes extremely great. Consequently, abnormal stoppage of the evacuating operation of each of the elevators 2 can be prevented, preventing occurrences such as building occupants being trapped inside the cars 3, for example.

Because each of the emergency broadcasting devices 7 issues a warning inside the building to the effect that the evacuating operation of each of the elevators 2 will terminate if a determination that continuation of the evacuating operation of the elevators 2 is impossible is issued by the evacuating operation determining portion 13, the building occupants can be made aware of termination of the evacuating operation of each of the elevators 2, enabling the occurrence of panic after the evacuating operation has been terminated to be prevented.

Moreover, in the above example, the evacuating operation of the elevators 2 is considered to be identical to normal operation with all of the service floors being designated as rescue floors, but operation in which only a predetermined service floor that has been predesignated from among the service floors is designated as a rescue floor and the cars 3 are moved back and forth between the rescue floor and the refuge floor, for example, may also be used as an evacuating operation. In that case, during the evacuating operation, the cars 3 will be stopped only at the rescue floor and the refuge floor, and will bypass all floors other than the rescue floor and the refuge floor. Building occupants who are on floors that are different from the rescue floor will move to the rescue floor using stairways that are disposed in the building in order to use the elevators 2. The number of floors at which the cars 3 stop can thereby be reduced, enabling transport efficiency to be improved when conveying the building occupants inside the building to the refuge floor.

Operating methods for the evacuating operation are not limited to the above methods, and may also be preset according to the shape, use, or occupant population of the building, for example.

In the above example, information relating to the estimated time of a terrorist attack (a time limit) that is included in operating input information from an external input device is input into the evacuating operation time calculating portion 12 as urgency level information, but information from the disaster prevention managing device 8 may also be input into the evacuating operation time calculating portion 12 as urgency level information.

For example, if a fire breaks out in the building, the disaster prevention managing device 8 can be made to detect the outbreak of fire and identify which floors fire has broken out on based on information from a plurality of fire sensors that are disposed on each floor of the building, and the evacuating operation time calculating portion 12 can be made to calculate the evacuating operation time based on the information from the disaster prevention managing device 8. In that case, the evacuating operation time calculating portion 12 can find the spreading velocity of the fire based on the information from the disaster prevention managing device 8 and calculate the evacuating operation time from the spreading velocity that it has found.

Evacuating operation of each of the elevators 2 can thereby also be terminated before the possibility that the operation of each of the elevators 2 will be stopped abnormally becomes extremely great. Consequently, abnormal stoppage of the evacuating operation of each of the elevators 2 can be prevented, preventing occurrences such as building occupants being trapped inside the cars 3, for example.

What is claimed is:

1. An elevator evacuation support apparatus that evacuates building occupants that have been left inside a building to a refuge floor in an emergency by managing operation of an elevator in which a plurality of floors function as service floors, the elevator evacuation support apparatus comprising:

an evacuating operation implementing portion that designates at least one of the service floors as a rescue floor, and that implements an evacuating operation for the elevator for transporting the building occupants from the rescue floor to the refuge floor;

an evacuating operation time calculating portion that receives urgency level information that indicates a degree of urgency, and that calculates an estimated amount of time for continuing the evacuating operation as an evacuating operation time based on the urgency level information; and an evacuating operation determining portion that determines ability to continue the evacuating operation based on information from the evacuating operation time calculating portion, the elevator evacuation support apparatus being characterized in that the evacuating operation implementing portion controls the evacuating operation based on information from the evacuating operation determining portion.

2. An elevator evacuation support apparatus according to claim 1, characterized in that:

a warning device is disposed in the building;

the elevator evacuation support apparatus further comprises a warning command portion that outputs a termination warning command to the warning device if a determination that continuation of the evacuating operation is impossible is issued by the evacuating operation determining portion; and the warning device issues a warning inside the building when the termination warning command is received to indicate that the evacuating operation will terminate.

* * * * *

UNITED STATES PATENT AND TRADEMARK OFFICE

CERTIFICATE OF CORRECTION

PATENT NO. : 7,963,372 B2
APPLICATION NO. : 12/161359
DATED : June 21, 2011
INVENTOR(S) : Shiro Hikita It is certified that error appears in the above-identified patent and that said Letters Patent is hereby corrected as shown below:

On the title page, Item (54), and column 1, the title is incorrect. Item (54) and column 1 should read:

-- ELEVATOR EVACUATION SUPPORT APPARATUS --

Signed and Sealed this
Thirtieth Day of August, 2011

David J. Kappos

David J. Kappos
*Director of the United States Patent and Trademark Office*